US007431259B2

(12) United States Patent
Tung

(10) Patent No.: US 7,431,259 B2
(45) Date of Patent: Oct. 7, 2008

(54) SUNSHADE BASE WITH SWIVEL SEAT

(76) Inventor: Benson Tung, No. 587, Chiengong Rd., Kaohsiung, Ditto (TW)

( * ) Notice: Subject to any disclaimer, the term of this patent is extended or adjusted under 35 U.S.C. 154(b) by 9 days.

(21) Appl. No.: 11/559,476

(22) Filed: Nov. 14, 2006

(65) Prior Publication Data

US 2008/0111046 A1 May 15, 2008

(51) Int. Cl.
*F16M 13/00* (2006.01)

(52) U.S. Cl. ..... 248/521; 248/523; 135/20.3

(58) Field of Classification Search ..... 248/521, 248/523, 129; 135/20.3
See application file for complete search history.

(56) References Cited

U.S. PATENT DOCUMENTS

| | | | | |
|---|---|---|---|---|
| 1,551,637 | A | 9/1925 | Bowlen | |
| 1,735,671 | A | 11/1929 | Bunker | |
| 1,788,030 | A | 1/1931 | Penn | |
| 2,351,293 | A | 6/1944 | Saunders | |
| 2,956,357 | A * | 10/1960 | Rakes | 40/457 |
| 3,042,350 | A * | 7/1962 | Lencioni | 47/40.5 |
| 3,415,475 | A | 12/1968 | Goodman | |
| 3,588,013 | A | 6/1971 | Mazak | |
| 3,841,631 | A | 10/1974 | Dolan | |
| 4,109,910 | A | 8/1978 | Gleason | |
| 4,201,975 | A | 5/1980 | Marcus | |
| 4,890,008 | A * | 12/1989 | Chu | 307/149 |
| 5,220,740 | A | 6/1993 | Brault | |
| 5,354,031 | A | 10/1994 | Bilotti | |
| 5,460,353 | A | 10/1995 | Rittenhouse | |
| 5,647,569 | A * | 7/1997 | Sofy | 248/522 |
| 5,842,670 | A | 12/1998 | Nigoghosian | |
| 5,875,578 | A | 3/1999 | Grewe | |
| 6,047,939 | A | 4/2000 | Kim | |
| 6,053,825 | A | 4/2000 | Allen et al. | |
| 6,299,183 | B1 | 10/2001 | Kaneko | |
| 6,305,659 | B1 | 10/2001 | Metelski | |
| 6,325,352 | B1 | 12/2001 | Story | |
| 6,367,494 | B1 | 4/2002 | Tung | |
| 6,585,219 | B2 * | 7/2003 | Li | 248/521 |
| 6,637,717 | B2 * | 10/2003 | Li | 248/519 |
| D485,055 | S | 1/2004 | Taylor | |
| 6,869,058 | B2 | 3/2005 | Tung | |
| 2003/0230692 | A1 * | 12/2003 | Davis et al. | 248/346.2 |

* cited by examiner

*Primary Examiner*—Amy J. Sterling
(74) *Attorney, Agent, or Firm*—Alan Kamrath; Kamrath & Associates PA

(57) ABSTRACT

A sunshade base includes a base, a swivel seat to which a support tube of a sunshade is mounted, a retaining member fixed to the swivel seat, and a braking device. The swivel seat includes a flange rotatably received in a recessed portion of a top face of the base. The braking device is mounted in the base and includes a rod movable in the base and a braking arm having a first end fixed to the rod and a second end releasably engaged with the retaining member. The second end of the braking arm is biased to engage with the retaining member to thereby lock the swivel seat. The rod is operable to disengage the second end of the braking arm from the retaining member to thereby allow free rotational movement of the swivel seat relative to the base.

20 Claims, 9 Drawing Sheets

SUNSHADE BASE WITH SWIVEL SEAT

BACKGROUND OF THE INVENTION

1. Field of the Invention

The present invention relates to a sunshade base and, more particularly, to a sunshade base to which a support tube of a sunshade is mounted.

2. Description of the Related Art

A typical sunshade may provide a shield for outdoor activities. The sunshade is bulky and heavy and, thus, requires a base to provide a stable support. The base has a considerable weight of tens of kilograms. As a result, it is difficult and inconvenient to move the sunshade to a desired position. Typically, the base has a seat to which the support tube of the sunshade is screwed. The base must be turned together with the support tube when it is desired to adjust the angular position of the canopy, which is inconvenient to the user.

U.S. Pat. No. 6,152,156 discloses a movable sunshade base including a base for engaging with a support tube of a sunshade and two wheel assemblies each having a mounting plate and at least one wheel rotatably mounted to the mounting plate. The mounting plate is pivotable between a storage position in which the wheel does not contact with the ground and an operative position in which the wheel is located on the ground and, thus, raises the base above the ground, allowing easy movement of the base to the desired position. The base also has a seat to which the support tube of the sunshade is screwed. However, it is difficult to turn the base while the support tube is attached to the seat.

BRIEF SUMMARY OF THE INVENTION

A sunshade base in accordance with the present invention comprises a base, a swivel seat, a retaining member fixed to the swivel seat, and a braking device. The base includes a top face and a bottom face. Each of the top face and the bottom face includes a recessed portion, with a through-hole extending between the recessed portions.

The swivel seat includes a flange rotatably received in the recessed portion of the top face of the base. The swivel seat further includes an upper tubular section adapted for receiving a support tube of a sunshade and a lower tubular section extending through the through-hole. The lower tubular section includes a lower end extending into the recessed portion of the bottom face of the base.

The braking device is mounted in the base and includes a rod movable in the base and a braking arm having a first end fixed to the rod and a second end releasably engaged with the retaining member. The sunshade base further includes means for biasing the second end of the braking arm to engage with the retaining member to thereby lock the swivel seat. The rod is operable to disengage the second end of the braking arm from the retaining member to thereby allow free rotational movement of the swivel seat relative to the base.

Hence, the angular position of the support tube can be conveniently adjusted when desired.

In an example, the rod includes an upper end extending beyond the top face of the base. A pedal is mounted to the upper end of the rod. The means for biasing the second end of the braking arm includes an elastic element mounted around the rod. This allows easy operation of the rod by simply stepping on the rod.

Preferably, the retaining member is a gear with a plurality of teeth on an outer circumference thereof, and the second end of the braking arm has a plurality of teeth for releasably engaging with the teeth of the retaining member. This allows engagement between the retaining member and the braking arm in any angular position.

In an example, the swivel seat includes an upper part having a first flange section from which the upper tubular section extends upward. The swivel seat further includes a lower part having a second flange section from which the lower tubular section extends downward. The first and second flange sections are fixed together and forming the flange of the swivel seat.

Preferably, the lower end of the lower tubular section of the swivel seat further includes outer threading and a nut engaged with the outer threading for restraining longitudinal movement of the swivel seat relative to the base.

Preferably, the through-hole further includes a bearing receiving section for receiving a bearing through which the lower tubular section extends. This allows smooth rotation of the swivel seat.

Preferably, the sunshade base further includes two wheel assemblies, and the base further includes two recessed sections each having an opening.

Preferably, each wheel assembly includes a handle, a shaft mounted to the handle, and at least one wheel mounted to the shaft. The handle includes a support section having two sides. A bracket is pivotally connected to each side of the support section and mounted to an inner wall of an associated one of the recessed sections, allowing each handle to pivot in the associated recessed section between a storage position in which the wheels do not contact the ground and an operative position in which the wheels are located on the ground and, thus raise the base above the ground. The wheel assemblies allow easy movement of the sunshade when desired.

Preferably, each wheel is a caster.

Preferably, the retaining member is fixed to the lower end of the lower tubular section of the swivel seat.

Preferably, the base includes a hole, and the rod is mounted in the hole and movable in a longitudinal direction of the hole.

Other advantages and novel features of the invention will become more apparent from the following detailed description when taken in conjunction with the accompanying drawings.

DETAILED DESCRIPTION OF THE INVENTION

Figure 1:
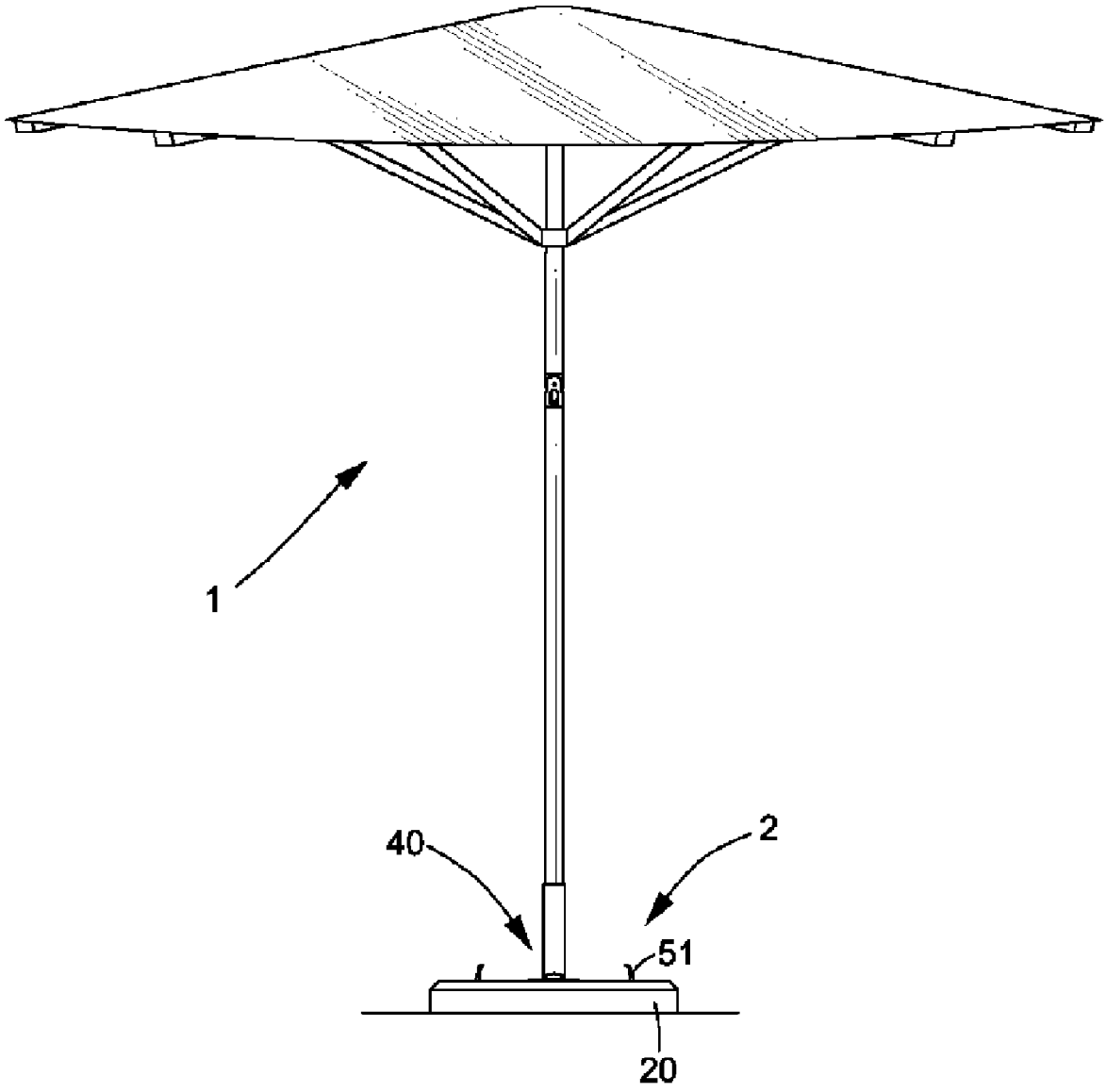
FIG. 1 is a perspective view of a sunshade with a sunshade base in accordance with the present invention.
Figure 2:
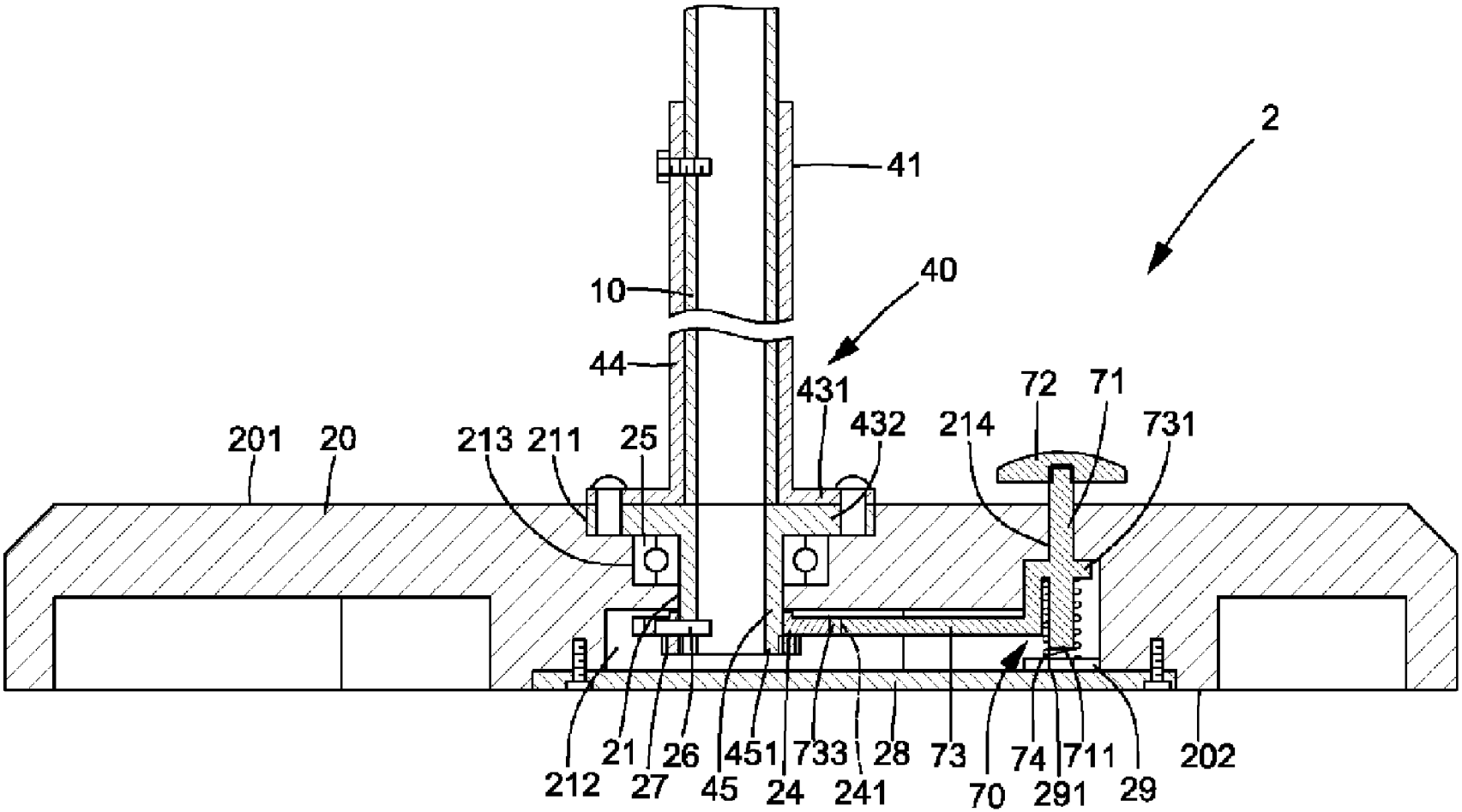
FIG. 2 is a sectional view illustrating a lower portion of the sunshade in FIG. 1.
Figure 3:
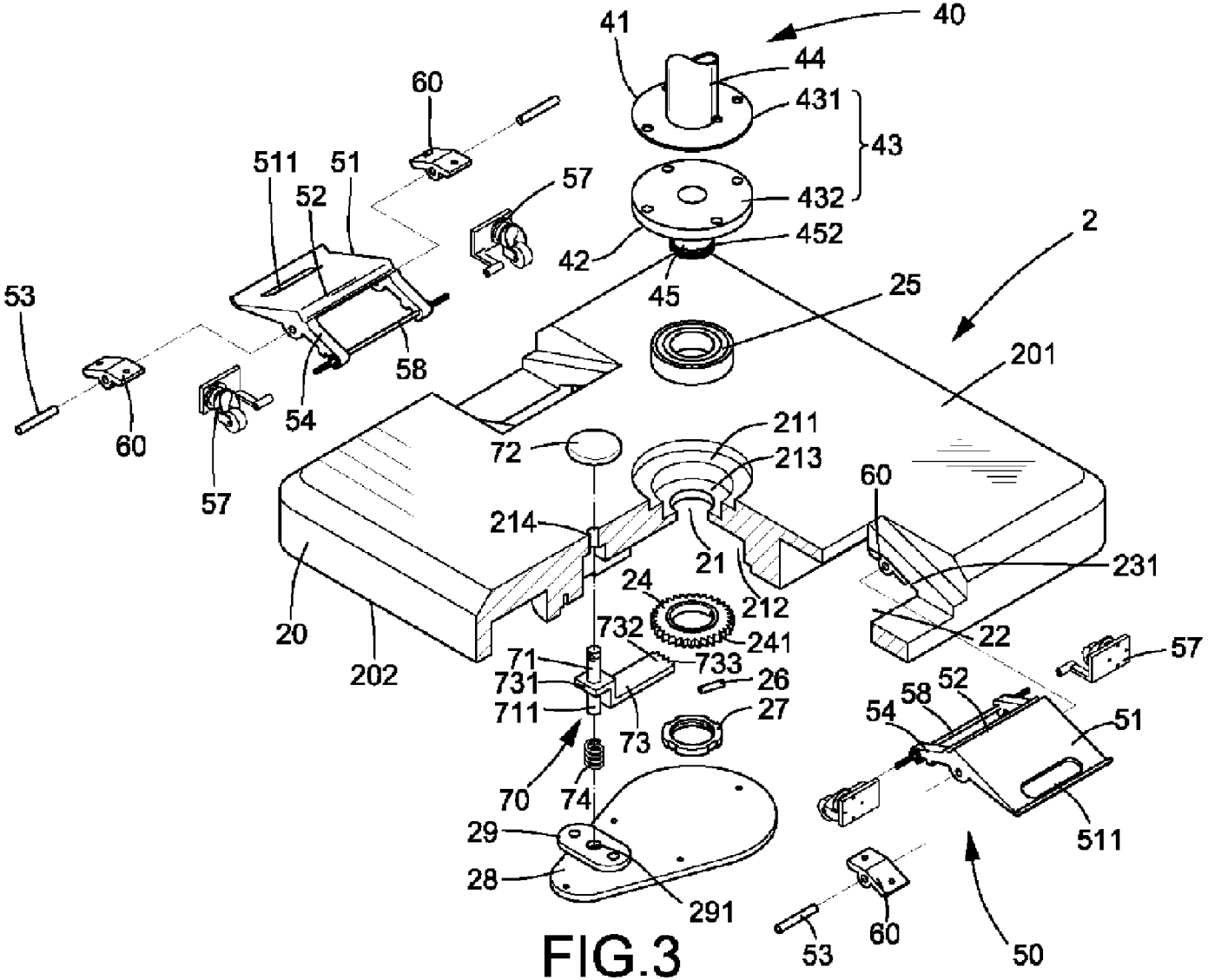
FIG. 3 is an exploded perspective view, partly cutaway, of the lower portion of the sunshade in FIG. 1.

Referring to FIGS. 1 through 3, a sunshade base 2 in accordance with the present invention is used to support a support tube 10 of a sunshade 1. Referring to FIGS. 2 and 3, the sunshade base 2 comprises a base 20, a swivel seat 40 rotatably mounted to the base 20, a retaining member 24 fixed to the swivel seat 40, and a braking device 70.

The base 20 includes a top face 201 and a bottom face 202. Each of the top face 201 and the bottom face 202 has a recessed portion 211, 212 in a central area thereof, with a through-hole 21 extending between bottom walls (not labeled) of the recessed portions 211 and 212. The through-hole 21 may include a bearing-receiving section 213 for receiving a bearing 25.

The swivel base 40 includes a flange 43 received in the recessed portion 211 of the top face 201 of the base 20. The swivel base 40 further includes an upper tubular section 44 to which a lower end of the support tube 10 is mounted. Further, the swivel base 40 includes a lower tubular section 45 that is rotatably extended through the bearing 25 and that has a lower end 451 extending into the recessed portion 212 of the bottom face 202 of the base 20. In this example, the swivel base 40 includes an upper part 41 and a lower part 42 assembled together by fasteners (not labeled). The upper part 41 includes a flange section 431 from which the upper tubular section 44 extends upward. The lower part 42 includes a flange section 432 from which the lower tubular section 45 extends downward. The flange sections 431 and 432 together form the flange 43 of the swivel seat 40.

In this example, the retaining member 24 is a gear fixed by a pin 26 to the lower end 451 of the lower tubular section 45 of the swivel base 40. The retaining member 24 has a plurality of teeth 241 on an outer circumference thereof. The lower end 451 of the lower tubular section 45 includes outer threading 452 for engaging with a nut 27 to restrain the axial position of the swivel seat 40 while allowing rotational movement of the swivel seat 40.

Figure 4:
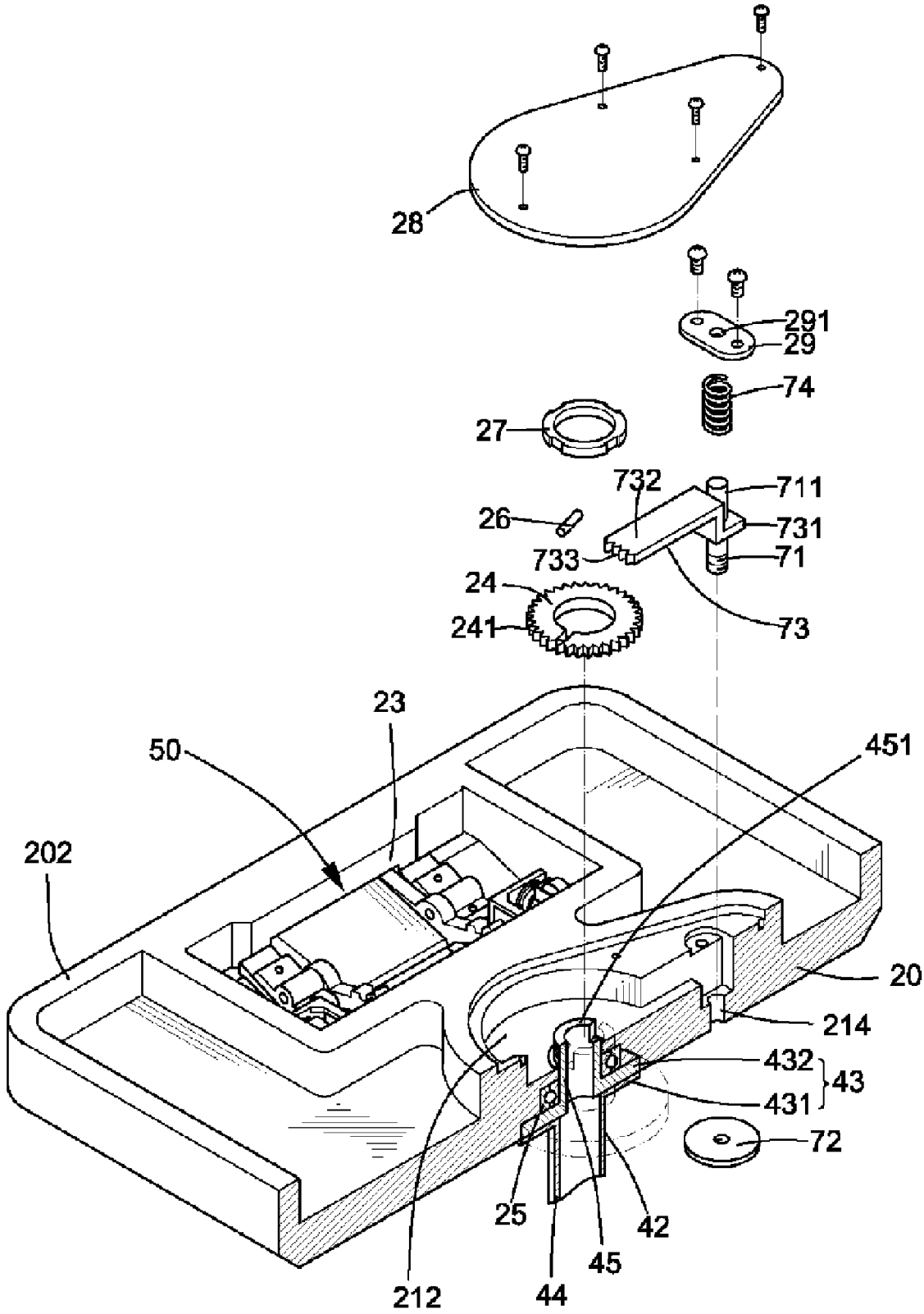
FIG. 4 is a partly-exploded, partly-cutaway bottom perspective view of the lower portion of the sunshade in FIG. 1.

Referring to FIGS. 2 and 4, the braking device 70 is mounted in the swivel base 40 and includes a rod 71 and a braking arm 73. In this example, the rod 71 is mounted in a hole 214 of the base 20 and slidable in a longitudinal direction of the hole 214. An upper end of the rod 71 extends upward beyond the top face 201 of the base 20, and a pedal 72 is fixed to the upper end of the rod 71. An elastic element 74 is mounted around the rod 71 for biasing the rod 71 and the braking arm 73 to a position engaged with the retaining member 24. In this example, the braking arm 73 includes a first end 731 fixed to the rod 71 and a second end 732 with teeth 733. The braking arm 73 is normally biased by the elastic element 74 upward to engage with the retaining member 24. A lid 28 is mounted to the bottom face 202 for covering the recessed portion 212. A block 29 may be fixed to an inner face of the lid 28, with the elastic element 74 mounted between the block 29 and the first end 731 of the braking arm 73. The block 29 further includes a hole 291 below the rod 71. When the rod 71 moves downward, the lower end 711 of the rod 71 moves into the hole 291 of the block 29.

Referring to FIG. 2, the braking arm 73 is normally biased upward by the elastic member 74 such that the teeth 733 of the braking arm 73 are engaged with the teeth 241 of the retaining member 24. Hence, the swivel seat 40 is normally locked and, thus, cannot turn. As a result, the support tube 10 fixed to the swivel seat 40 is also fixed relative to the base 20.

Figure 5:
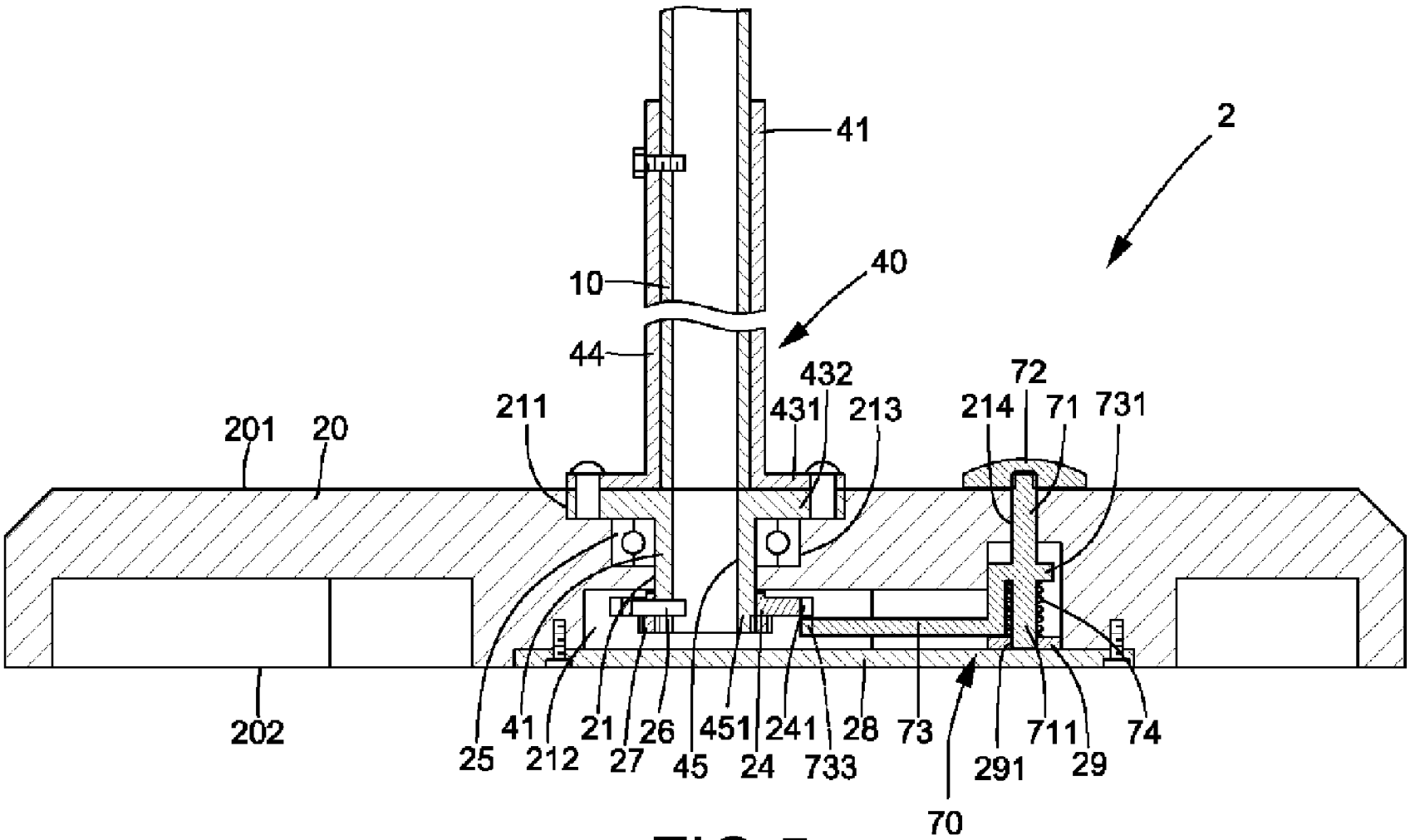
FIG. 5 is a view similar to FIG. 4, wherein a support tube of the sunshade is in a rotatable state.
Figure 9:
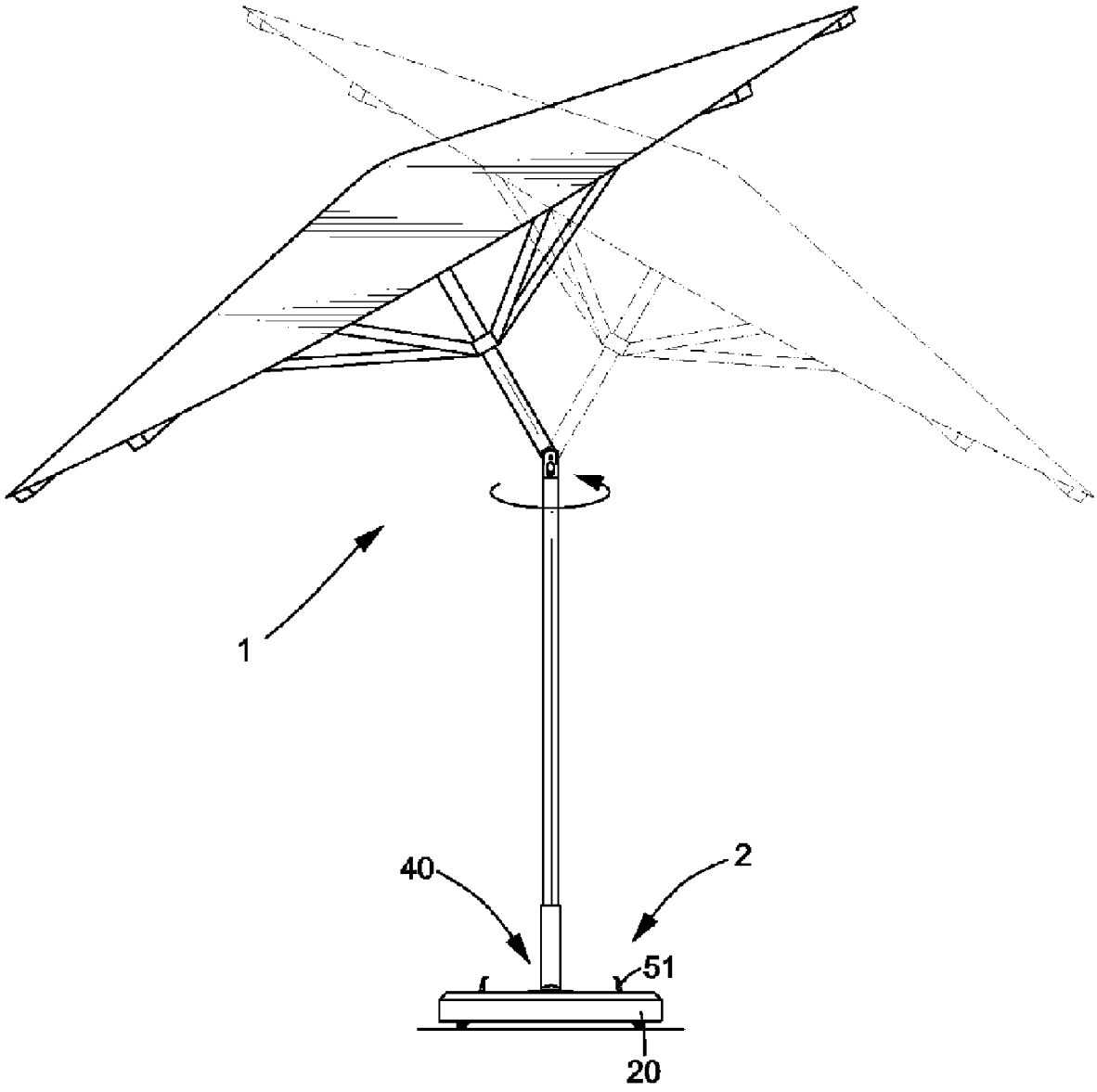
FIG. 9 is a view similar to FIG. 1, wherein two handles of the sunshade base are pulled upward.

Referring to FIG. 5, in a case that a user wants to turn the support tube 10 for adjusting the orientation of the canopy (not labeled) of the sunshade 1, the pedal 72 can be pressed to overcome the elastic element 74, which, in turn, causes downward movement of the rod 71 and the braking arm 73. The braking arm 73 is disengaged from the retaining member 24 to allow rotation of the swivel seat 40 and the support tube 10 (see FIG. 9). After the support tube 10 is turned to the desired angular position, the pedal 72 is released, and the braking arm 73 is engaged again with the retaining member 24 under the action of the elastic element 74.

Figure 6:
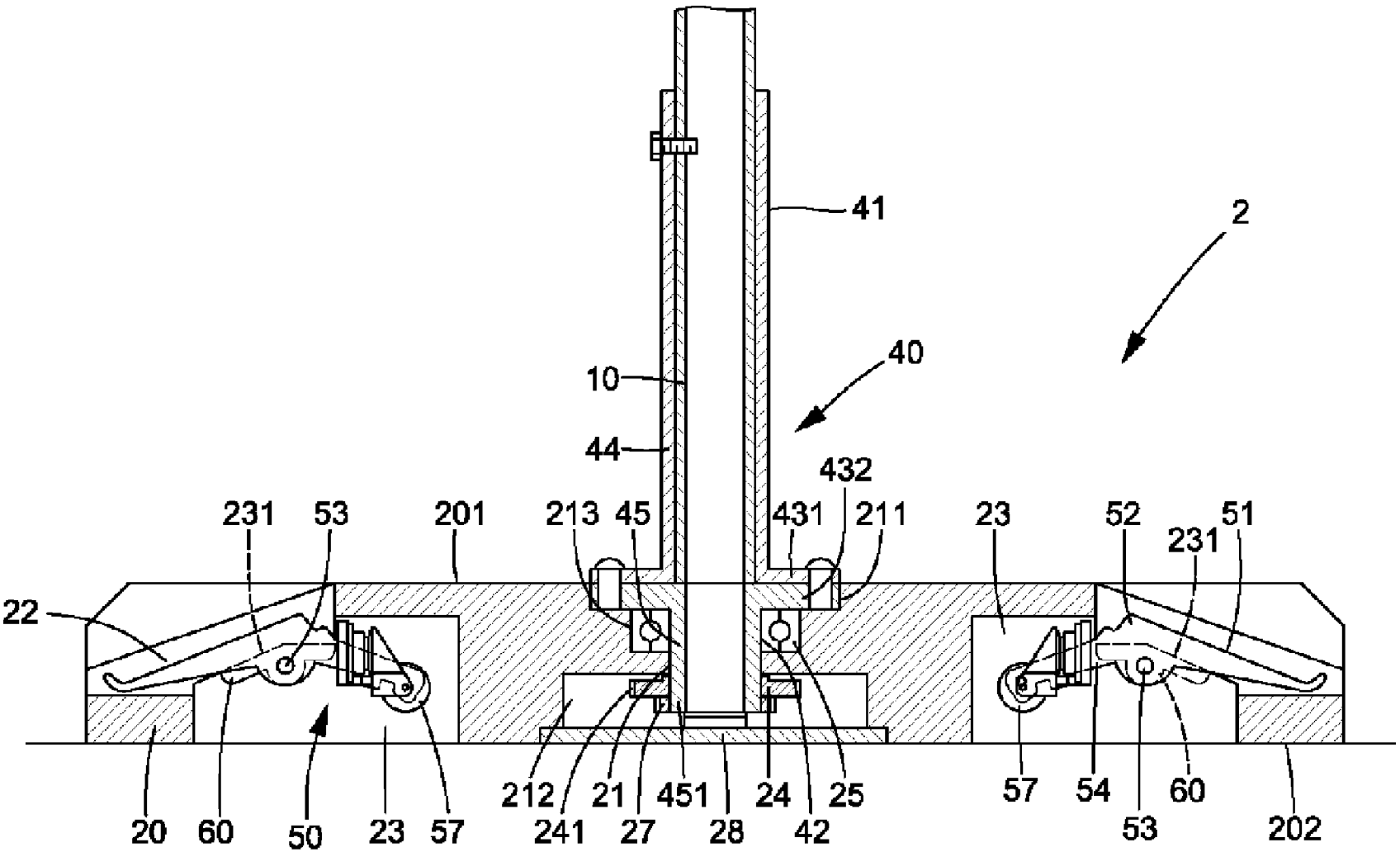
FIG. 6 is another sectional view of the lower portion of the sunshade in FIG. 1.
Figure 7:
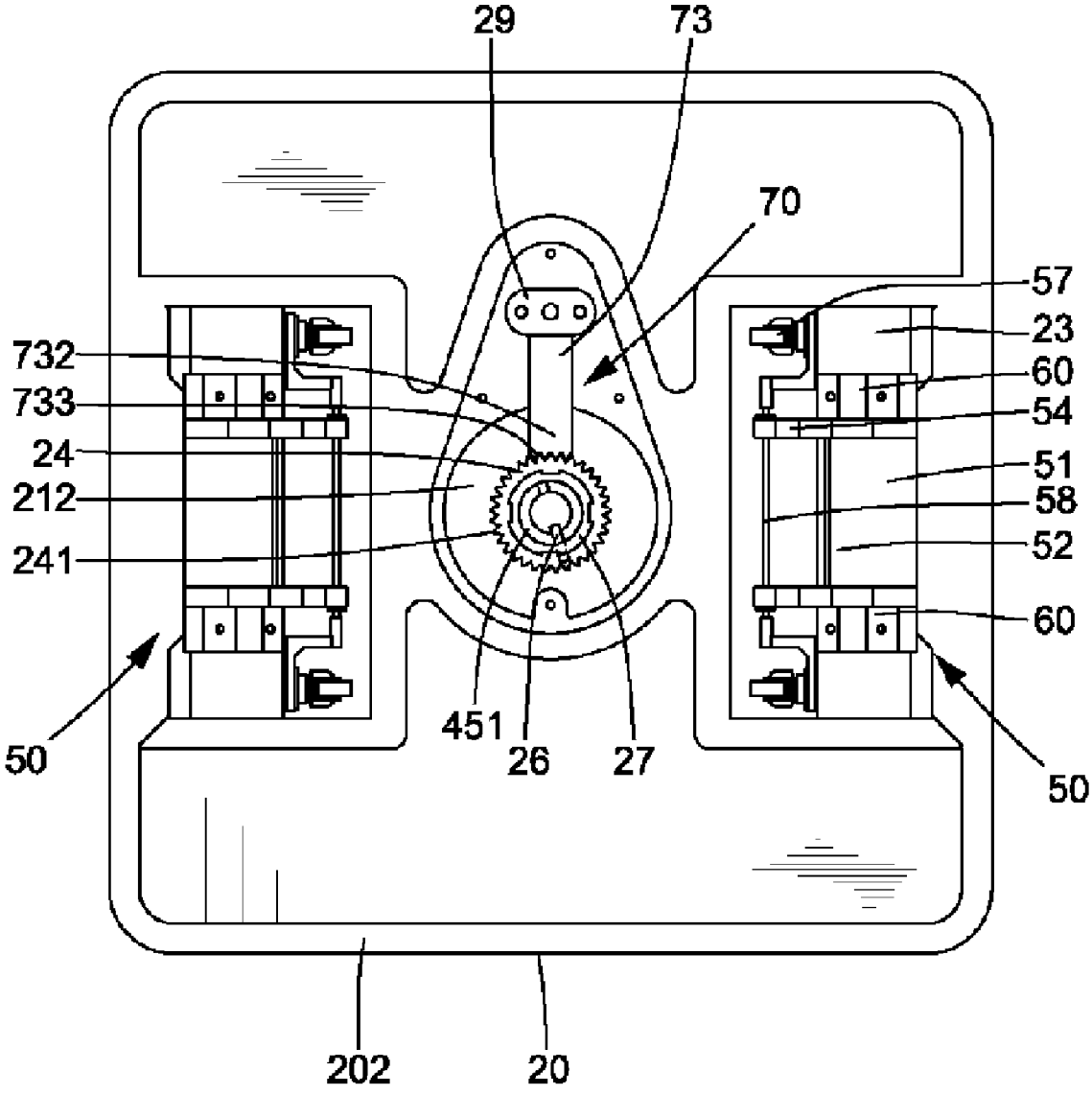
FIG. 7 is a bottom view of the sunshade in FIG. 6.

Referring to FIGS. 3, 6, and 7, the sunshade base 2 in accordance with the present invention may further include two wheel assemblies 50, and the base 20 includes two recessed sections 23 for mounting the wheel assemblies 50. Each recessed section 23 has an opening 22. Each wheel assembly 50 includes a handle 51, a shaft 58, and at least one wheel 57 (two casters in this example). Each handle 51 has a slot 511 and a support section 52. Two lugs 54 extend from the support section 52, with the shaft 58 extending through distal ends of the lugs 54. The casters 57 are rotatably fixed to two ends of the shaft 58. A bracket 60 is pivotally connected by a pin 53 to each of two sides of the support section 52. Each bracket 60 is mounted to an inner wall 231 of an associated recessed portion 23, with the associated handle 51 rotatably received in the associated recessed portion about the pin 53.

Figure 8:
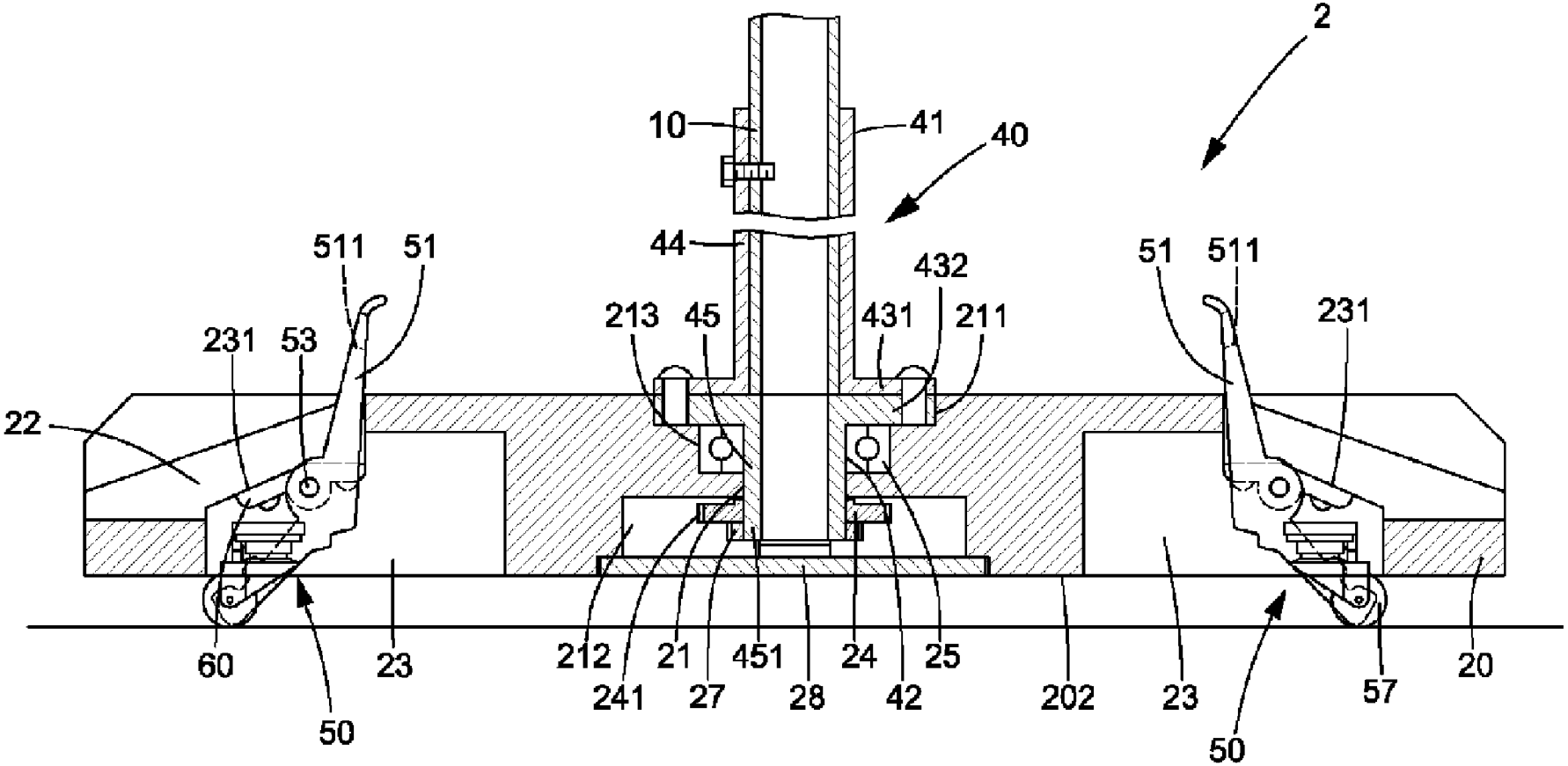
FIG. 8 is a view similar to FIG. 6, wherein two handles of the sunshade base are pulled upward.

Referring to FIG. 8, when movement of the sunshade base 2 is required, the user may insert his or her fingers into the slot 511 of each handle 51 and pulls the handle 51 upward. The casters 57 are moved to a position in contact with the ground and, thus, lift the sunshade base 2 upward to a level above the ground. Thus, the sunshade base 2 can be moved to the desired location with less effort. When the sunshade base 2 reaches the desired location, the handles 51 are pivoted back to the position shown in FIG. 6 in which the casters 57 are hidden in the base 20.

Although a specific embodiment has been illustrated and described, numerous modifications and variations are still possible. The scope of the invention is limited by the accompanying claims.

What is claimed is:

1. A sunshade base comprising:

a base including a top face and a bottom face, each of the top face and the bottom face including a recessed portion with a through-hole extending between the recessed portions;

a swivel seat including a flange rotatably received in the recessed portion of the top face of the base, the swivel seat further including an upper tubular section adapted for receiving a support tube of a sunshade and a lower tubular section extending through the through-hole, the lower tubular section including a lower end extending into the recessed portion of the bottom face of the base;

a retaining member fixed to the swivel seat;

a braking device mounted in the base, the braking device including a rod movable in the base and a braking arm having a first end fixed to the rod and a second end releasably engaged with the retaining member; and means for biasing the second end of the braking arm to engage with the retaining member to thereby lock the swivel seat;

wherein the rod is operable to disengage the second end of the braking arm from the retaining member to thereby allow free rotational movement of the swivel seat relative to the base, with the rod including an upper end extending beyond the top face of the base, with a pedal being mounted to the upper end of the rod, and with said means for biasing the second end of the braking arm including an elastic element mounted around the rod.

2. A sunshade base as comprising:

a base including a top face and a bottom face, each of the top face and the bottom face including a recessed portion, with a through-hole extending between the recessed portions;

a swivel seat including a flange rotatably received in the recessed portion of the top face of the base, the swivel seat further including an upper tubular section adapted for receiving a support tube of a sunshade and a lower tubular section extending through the through-hole, the lower tubular section including a lower end extending into the recessed portion of the bottom face of the base;

a retaining member fixed to the swivel seat;

a braking device mounted in the base, the braking device including a rod movable in the base and a braking arm having a first end fixed to the rod and a second end releasably engaged with the retaining member; and means for biasing the second end of the braking arm to engage with the retaining member to thereby lock the swivel seat;

wherein the rod is operable to disengage the second end of the braking arm from the retaining member to thereby allow free rotational movement of the swivel seat relative to the base, with the retaining member being a gear with a plurality of teeth on an outer circumference thereof, with the second end of the braking arm having a plurality of teeth for releasably engaging with the teeth of the retaining member.

3. A sunshade base comprising:

a base including a top face and a bottom face, each of the top face and the bottom face including a recessed portion, with a through-hole extending between the recessed portions;

a swivel seat including a flange rotatably received in the recessed portion of the top face of the base, the swivel seat further including an upper tubular section adapted for receiving a support tube of a sunshade and a lower tubular section extending through the through-hole, the lower tubular section including a lower end extending into the recessed portion of the bottom face of the base;

a retaining member fixed to the swivel seat;

a braking device mounted in the base, the braking device including a rod movable in the base and a braking arm having a first end fixed to the rod and a second end releasably engaged with the retaining member; and means for biasing the second end of the braking arm to engage with the retaining member to thereby lock the swivel seat;

wherein the rod is operable to disengage the second end of the braking arm from the retaining member to thereby allow free rotational movement of the swivel seat relative to the base, with the swivel seat including an upper part having a first flange section from which the upper tubular section extends upward, with the swivel seat further including a lower part having a second flange section from which the lower tubular section extends downward, with the first and second flange sections being fixed together and forming the flange of the swivel seat.

4. A sunshade base comprising:

a base including a top face and a bottom face, each of the top face and the bottom face including a recessed portion, with a through-hole extending between the recessed portions;

a swivel seat including a flange rotatably received in the recessed portion of the top face of the base, the swivel seat further including an upper tubular section adapted for receiving a support tube of a sunshade and a lower tubular section extending through the through-hole, the lower tubular section including a lower end extending into the recessed portion of the bottom face of the base;

a retaining member fixed to the swivel seat;

a braking device mounted in the base, the braking device including a rod movable in the base and a braking arm having a first end fixed to the rod and a second end releasably engaged with the retaining members; and means for biasing the second end of the braking arm to engage with the retaining member to thereby lock the swivel seat;

wherein the rod is operable to disengage the second end of the braking arm from the retaining member to thereby allow free rotational movement of the swivel seat relative to the base, with the lower end of the lower tubular section of the swivel seat further including outer threading and a nut engaged with the outer threading for restraining longitudinal movement of the swivel seat relative to the base.

5. The sunshade base as claimed in claim 1, with the through-hole further including a bearing receiving section for receiving a bearing through which the lower tubular section extends.

6. The sunshade base as claimed in claim 1, with the sunshade base further including two wheel assemblies, with the base further including two recessed sections each having an opening.

7. The sunshade base as claimed in claim 6, with each said wheel assembly including a handle, a shaft mounted to the handle, and at least one wheel mounted to the shaft, the handle including a support section having two sides, a bracket being pivotally connected to each said side of the support section and mounted to an inner wall of an associated one of the recessed sections, allowing each said handle to pivot in the associated recessed section between a storage position in which at least one wheel of each said wheel assembly does not contact the ground and an operative position in which at least one wheel of each said wheel assembly is located on the ground and, thus raise the base above the ground.

8. The sunshade base as claimed in claim 7, with said at least one wheel of each said wheel assembly being a caster.

9. The sunshade base as claimed in claim 1, with the retaining member being fixed to the lower end of the lower tubular section of the swivel seat.

10. The sunshade as claimed in claim 1, with the base including a hole, with the rod being mounted in the hole and movable in a longitudinal direction of the hole.

11. The sunshade base as claimed in claim 2, with the through-hole further including a bearing receiving section for receiving a bearing through which the lower tubular section extends.

12. The sunshade base as claimed in claim 2, with the sunshade base further including two wheel assemblies, with the base further including two recessed sections each having an opening.

13. The sunshade base as claimed in claim 12, with each said wheel assembly including a handle, a shaft mounted to the handle, and at least one wheel mounted to the shaft, the handle including a support section having two sides, a bracket being pivotally connected to each said side of the support section and mounted to an inner wall of an associated one of the recessed sections, allowing each said handle to pivot in the associated recessed section between a storage position in which at least one wheel of each said wheel assembly does not contact the ground and an operative position in which at least one wheel of each said wheel assembly is located on the ground and, thus raise the base above the ground.

14. The sunshade base as claimed in claim 3, with the through-hole further including a bearing receiving section for receiving a bearing through which the lower tubular section extends.

15. The sunshade base as claimed in claim 3, with the sunshade base further including two wheel assemblies, with the base further including two recessed sections each having an opening.

16. The sunshade base as claimed in claim 15, with each said wheel assembly including a handle, a shaft mounted to the handle, and at least one wheel mounted to the shaft, the handle including a support section having two sides, a bracket being pivotally connected to each said side of the support section and mounted to an inner wall of an associated one of the recessed sections, allowing each said handle to pivot in the associated recessed section between a storage position in which at least one wheel of each said wheel assembly does not contact the ground and an operative position in which at least one wheel of each said wheel assembly is located on the ground and, thus raise the base above the ground.

17. The sunshade as claimed in claim 4, with the base including a hole, with the rod being mounted in the hole and movable in a longitudinal direction of the hole.

18. The sunshade base as claimed in claim 4, with the through-hole further including a bearing receiving section for receiving a bearing through which the lower tubular section extends.

19. The sunshade base as claimed in claim 4, with the sunshade base further including two wheel assemblies, with the base further including two recessed sections each having an opening.

20. The sunshade base as claimed in claim 19, with each said wheel assembly including a handle, a shaft mounted to the handle, and at least one wheel mounted to the shaft, the handle including a support section having two sides, a bracket being pivotally connected to each said side of the support section and mounted to an inner wall of an associated one of the recessed sections, allowing each said handle to pivot in the associated recessed section between a storage position in which at least one wheel of each said wheel assembly does not contact the ground and an operative position in which at least one wheel of each said wheel assembly is located on the ground and, thus raise the base above the ground.

* * * * *